United States Patent [19]

LaBate

[11] 4,187,334

[45] Feb. 5, 1980

[54] PROCESS AND MATERIAL FOR TREATING STEEL WALLS AND FANS IN ELECTRICAL PRECIPITATION INSTALLATIONS WITH MICRON COLLOIDAL GRAPHITE PARTICLES

[76] Inventor: Micheal D. La Bate, 115 Hazen Ave., Ellwood City, Pa. 16117

[21] Appl. No.: 956,497

[22] Filed: Nov. 1, 1978

[51] Int. Cl.[2] ..... B05D 7/22

[52] U.S. Cl. ..... 427/236; 427/239; 427/318; 427/327

[58] Field of Search ..... 427/236, 239, 181, 318, 427/327, 376 R, 376 E, 122, 135; 134/4; 106/307

[56] References Cited

U.S. PATENT DOCUMENTS

| | | | |
|---|---|---|---|
| 2,245,747 | 6/1941 | Barr | 427/135 |
| 2,246,463 | 6/1941 | Garratt | 427/318 |
| 2,618,032 | 11/1952 | Traenkner | 106/38.22 |
| 4,098,929 | 7/1978 | Badone et al. | 427/135 |

FOREIGN PATENT DOCUMENTS

| | | | |
|---|---|---|---|
| 251401 | 5/1964 | Australia | 427/135 |
| 785823 | 11/1957 | United Kingdom | 427/135 |
| 1198363 | 7/1970 | United Kingdom | 427/135 |

*Primary Examiner*—Michael R. Lusignan
*Attorney, Agent, or Firm*—Webster B. Harpman

[57] ABSTRACT

A process of treating the interior steel walls and gas and/or air moving fans or blowers in electrical precipitation installations with a material containing micron colloidal particles of graphite in a liquid carrier is described that forms a penetrating and surface coating on the interior walls and fan blades and blower parts of the electrical precipitation installation and which acts to prevent the accumulation of coal tar, dust, fly ash and other particles thereon.

4 Claims, No Drawings

PROCESS AND MATERIAL FOR TREATING STEEL WALLS AND FANS IN ELECTRICAL PRECIPITATION INSTALLATIONS WITH MICRON COLLOIDAL GRAPHITE PARTICLES

BACKGROUND OF THE INVENTION

1. Field of the Invention

This invention relates to electrical precipitators as used in cleaning flue gasses in power plants, blast furnaces, coke ovens and the like and a method and material for treating the steel parts of such devices to prevent circulation restricting accumulation of particulate matter therein.

2. Description of the Prior Art

Fossil fueled power plants, such as used in electrical and steam generating installations, blast furnaces and coke ovens, have heretofore been provided with various flue gas scrubbers and electrical precipitators for removing particulate material which would otherwise be discharged with the flue gasses and pollute the atmosphere. The electrical precipitators collect solid or liquid particles suspended in a gas by means of a unidirectional electric field, the precipitated particles being attracted to and collected on the positive electrode of the precipitator. In order that the solid or liquid particles may reach the positive electode of the precipitator, the communicating passageways must be kept open and the prior art installations have provided no means of assuring the non-blocking accumulation of particles in such passageways.

In electrical power or steam generating plants, considerable fly ash and other objectionable particulate matter is encountered. In blast furnaces coke, limestone and iron ore dusts are produced and in coke ovens coal tar and other by-products build up deposits which are difficult to remove and which like the other particulate matter accumulate and block the passageways through the precipitators.

The present invention relates to a process of building up a penetrating coating on the inner walls and fan blades or blower parts in the electrical precipitation devices with a material that is not affected by the heat of the operation and to which tar and other solid or liquid particles suspended in a gas will not adhere with the result that the passageways, fan blades and/or blower parts remain clean and free of solid or liquid particle build-up.

No prior art is known which relates to a material capable of such use or a process of using it. The dictionary description of "micron" is "A colloidal particle whose diameter is between 0.2 and 10 millionths of a meter." The dictionary description of "colloidal" is "Pretaining to or of the nature of a colloid." The dictionary description of "colloid" is "Colloidal particles are about $10^{-7}$ to $5\times10^{-5}$ CM in diameter, larger than most inorganic molecules."

SUMMARY OF THE INVENTION

A process and material for treating the interior steel walls and fans and blowers in electrical precipitation installations to prevent the build-up of solid or liquid particles suspended in the gasses being treated comprising a coating of the inner walls and steel fan blades and blower parts as by spraying or other application with a material which is essentially micron colloidal particles of graphite in a liquid carrier wherein the extremely fine dispersion of the graphite lowers the surface tension of the carrier and enables the graphite to penetrate the surfaces of the steel walls, fan blades and blower parts being treated and build up a smooth surface coating. The liquid carrier comprises water, alcohol, and one or more liquid soaps which contribute to the penetrating and coating ability of the material.

DESCRIPTION OF THE PREFERRED EMBODIMENT

The material of this invention is particularly suitable for building up penetrating smooth surface coatings on the inner steel walls of electrical precipitation installations including fan steel blades and blower parts therein and comprises substantially between 5% and 95% by weight micron colloidal particles of graphite, between 5% and 95% by weight water, between 5% and 95% by weight alcohol, and between 1% and 2% by weight liquid soap. Alternately the range of percentage by weight of the ingredients may be between 5% and 95% micron colloidal particles of graphite, between 5% and 95% of a half and half mixture of water and alcohol and between 1% and 2% liquid soap. The alcohol may be any hydrocarbon compound containing a hydrogen atom substituted by the hydroxyl. A typical alcohol is ethyl alcohol. The liquid soap may be any of the alkaline salts of palmitic, stearic or oleic acid and preferably contain potassium salts. Additionally the so-called resin soaps may be employed and/or a synthetic detergent in an aqueous solution such as sodium laurel sulfate or triethanolamine laurate or amyl acetate. A typical aqueous solution is 50% water and 50% soap solids. Those skilled in the art will observe that the various soft soaps or their equivalents as set forth hereinbefore comprise effective wetting agents which contribute to the ability of the micron colloidal particles of graphite to penetrate the metal comprising the inner walls, fan blades and/or blower parts of the electrical precipitation installations, and form a dry smooth coating.

Those skilled in the art will also observe that the percentages of the micron colloidal particles of graphite and their liquid carrier may be widely varied depending upon the number of applications of the material to the metal parts being treated and it has been determined that some metals used in the duct work walls, fan blades, and blower parts in electrical precipitation installations are advantageously treated in accordance with this invention by preheating said metal surfaces and/or parts immediately prior to the application of the material in the process herein disclosed. For example small percentages of the micron colloidal particles of graphite and the liquid carrier preform effectively when a number of applications of the material are applied and when only one or a few applications of the material are applied to the metal surfaces then the higher percentages of the micron colloidal particles of graphite are more desireable. In either case the material penetrates the metal surfaces being treated and builds up an extremely smooth slick surface coating to which fly ash and other particulate matter including solid or liquid particles suspended in the flue gases will not adhere or if some adherence occurs the adhering material may be easily removed from the treated surfaces by air jets or the like.

In using the material disclosed herein, the process involves mixing the material to form a liquid suspension of the micron colloidal particles of graphite and then spraying the same by any suitable spraying equipment on cleaned metal surfaces of the inner steel walls, fan blades, and/or blower parts of the electrical precipitation installations being treated. One or more coatings are applied as necessary to build up a smooth unbroken surface of the material on the metal surfaces being treated and the material may be applied to the metal surfaces, while they are either hot or cold as aforesaid. The ability of the material to be applied to and remain on hot steel surfaces is particularly advantages in power plants, blast furnace and coke oven installations as the flue gases being handled are of high temperature.

Those skilled in the art will observe that the heretofore necessary manual cleaning of the inner steel wall surfaces, fan blades and/or blower parts required considerable down time of the particular electrical precipitation installation being cleaned and that this down time is now largely eliminated through the use of the material and process disclosed herein.

It will be observed that the operation of an electrical precipitator is improved and stabilized by providing for the effective coating of the inner walls and passageways, fan blades and blower parts thereof to prevent the accumulation of materials thereon and that as customary the normal dual installations can be alternated with the cleaning of the collecting electrodes performed rapidly as the passageways, inner walls, and other parts of the circulatory systems remain clean and free of circulation interfering build ups of particulate matter and the like.

The following specific examples of the material have been found satisfactory.

A. 33% micron colloidal particles of graphite by weight, 65% water by weight and 2% liquid soap by weight.

B. 70% micron colloidal particles of graphite by weight, 28% alcohol by weight and 2% liquid soap by weight.

C. 70% micron colloidal particles of graphite by weight, 28% of water by weight, and 2% liquid soap by weight.

D. 51% micron colloidal particles of graphite by weight, 24% water by weight, 23% alcohol by weight, and 2% liquid soap by weight.

In the present process the material is preferably applied to the metal inner walls, pipes and duct work, fan blades, shafts and housings and/or blowers including the driving means therefor, all of which are preferably heated and the material applied by spraying the liquid suspension material disclosed herein. Under such conditions the micron colloidal particles of graphite aided the liquid carrier penetrates the metal surfaces which have been previously cleaned and the material builds up a smooth coating, which being largely graphite is able to resist heat and wear and maintain its penetration and coating characteristics indefinitely. At such time as the smooth surface is eroded, it may be cleaned and recoated quickly and easily.

As used in treating electrical precipitation equipment on blast furnaces and coke ovens or the like where high temperature flue gases are handled, the liquid carrier may be largely fluid silicon, which may be any of the oils, greases, resins and synthetic rubber materials which are made by substituting silicon for carbon in an organic substance. The following specific example of a material having a liquid silicon carrier has been found satisfactory:

E. 70% micron colloidal particles of graphite by weight, 30% liquid silicon by weight.

Although the embodiments of the present invention have been limited as described hereinbefore, it will be apparent to those skilled in the art that various changes and modifications may be made in the process and the material without departing from the spirit of the invention and having thus described my invention what I claim is:

1. A process of treating the inner steel walls and fluid handling and moving devices in electrical precipitation installations that consists essentially of the steps of cleaning said steel walls and devices, penetrating a liquid suspension of micron colloidal particles of graphite into said cleaned steel walls and devices so as to build up a smooth covering coating on said steel walls and devices, said micron colloidal suspension including more than about 15% by weight micron colloidal particles of graphite and less than about 75% by weight micron colloidal particles of graphite, between about 15% to 75% by weight water, between about 15% to 75% by weight alcohol and substantially about 1% to 2% by weight liquid soap, and drying said coating to form a slick, smooth surface.

2. The process of claim 1 and wherein several penetrating coatings of said liquid suspension of micron colloidal particles of graphite are applied to said steel walls and devices successively.

3. The process of claim 1 and wherein several penetrating coatings of said liquid suspension of micron colloidal particles of graphite are sprayed on said steel walls and devices successively.

4. The process of claim 1 and wherein said steel walls and devices are heated prior to said application of said penetrating coating of said liquid suspension of micron colloidal particles of graphite, said walls and devices being heated to a temperature sufficient to facilitate the penetration of the said liquid suspension of micron colloidal particles of graphite into the steel due to the expanded grain structure of the steel by said heat.

* * * * *